US009666044B1

(12) United States Patent
Buller et al.

(10) Patent No.: US 9,666,044 B1
(45) Date of Patent: May 30, 2017

(54) DOOR SECURITY SYSTEM

(71) Applicants: Terry J. Buller, Houston, TX (US); Lawrence Pirek, Houston, TX (US)

(72) Inventors: Terry J. Buller, Houston, TX (US); Lawrence Pirek, Houston, TX (US)

( * ) Notice: Subject to any disclaimer, the term of this patent is extended or adjusted under 35 U.S.C. 154(b) by 39 days.

(21) Appl. No.: 14/938,260

(22) Filed: Nov. 11, 2015

(51) Int. Cl.
*G08B 13/08* (2006.01)
*E05C 19/00* (2006.01)
*E05C 19/18* (2006.01)

(52) U.S. Cl.
CPC ..... *G08B 13/08* (2013.01); *E05C 19/00* (2013.01); *E05C 19/18* (2013.01); *E05C 19/182* (2013.01)

(58) Field of Classification Search
CPC ..... G08B 13/08; E05C 19/00; E05C 19/18; E05C 19/182
USPC ..... 340/545.8, 545.5, 565, 566; 200/61.93
See application file for complete search history.

(56) References Cited

U.S. PATENT DOCUMENTS 4,300,796 A 11/1981 Lane
4,358,758 A 11/1982 Morton
4,483,558 A 11/1984 Van Meter
4,563,027 A 1/1986 Chechovsky et al.
4,607,253 A 8/1986 Wooten et al.
5,309,145 A 5/1994 Branch et al.
5,311,168 A * 5/1994 Pease, Jr. ..... G08B 13/08 200/61.93
5,392,026 A 2/1995 Marik
5,712,623 A 1/1998 Kumai et al.
6,011,469 A * 1/2000 Taft ..... H01H 36/0033 340/545.1
7,246,449 B2 * 7/2007 Pierson ..... E05B 17/06 33/194
8,643,486 B2 2/2014 Hess
2008/0297367 A1 12/2008 Chen
2011/0140463 A1 * 6/2011 Nalepka ..... E05C 19/18 292/344
2011/0254689 A1 * 10/2011 Snyder ..... G08B 13/08 340/545.5

* cited by examiner

*Primary Examiner* — John A Tweel, Jr.
(74) *Attorney, Agent, or Firm* — Egbert Law Offices, PLLC

(57) ABSTRACT

A security system for use with the door with a door jamb has a plate member mountable in the door jamb adjacent hinges of the door. The plate member has a protrusion extending outwardly therefrom. A bracket member has a slot therein for receipt of the protrusion of plate member. The bracket member has first and second wings extending outwardly therefrom so as to bear against the door and surface adjacent the door when the bracket member is received by the plate member. The bracket member has an alarm receiver on a front side thereof. A vibration-activated alarm is removably received by the alarm receiver. The vibration activated alarm can be utilized during travel and is attachable to any door, even without the plate member and bracket member.

20 Claims, 5 Drawing Sheets

DOOR SECURITY SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the field of home security. More particularly, the present invention relates to a door securement apparatus. Even more particularly, the present invention relates to a door securement apparatus with a removable alarm that can be utilized during travel.

2. Description of Related Art Including Information Disclosed Under 37 CFR 1.97 and 37 CFR 1.98.

Home invasions and break-ins are a common concern amongst the people of the United States. It is very important for people to maintain a good sense of security in one's home, and also during travel. Travelers often find themselves in lodging wherein they are in a room protected only by a simple lock. In many cases, the simple locks are supplemented by chains or other relatively ineffective door securement devices. Supplemental devices which enhance the security, or sense thereof, include portable locks, alarm devices which do not interfere with the operation of the door, and door brace systems.

Various patent have issued in the past relating to portable locks and alarms. For example, U.S. Pat. No. 4,300,796, issued on Nov. 17, 1981 to Lane, describes an adjustable door and window security prop. In the device of the Lane patent, adjustable large and small diameter tubular members are telescopic engaged with each other. A U-shaped member is attached to one of these legs so as to engage the door handle. A stop is provided at the bottom of the member for frictional engagement with the floor. A lock structure is provided so as to cause the fixed engagement between the tubular members.

Some patents, such as U.S. Pat. No. 4,358,758, issued on Nov. 9, 1982 to Morton, describe combination door locks and alarms. Generally speaking, these types of devices are braces which engage with both the door handle and the floor.

Various patents have issued in the past relating to portable alarms which can be utilized in different settings. For example, U.S. Pat. No. 8,643,486, issued on Feb. 4, 2014 to Hess, describes a portable alarm device which can be used in a hotel. The alarm device issues an audible siren and is cellular-capable. The portable alarm device may be attached to surfaces using a variety of means including magnetic attachments.

U.S. Patent Publication No. 2008/0297367 published on Dec. 4, 2008 to Chen, describes a multi-purpose portable alarm which can be used as a vibration-activated door alarm.

U.S. Pat. No. 5,712,623, issued on Jan. 27, 1998 to Kumai et al., discloses an alarm device. The alarm device is hung on a doorknob and is configured to emit an alarm upon detecting human body contact or movement of the doorknob. The alarm device has a data processor and an electrical display for displaying data processed by the data processor and information related to the operation of the alarm. A hanging member is rotatably mounted to the alarm device so as to suspend the alarm device from the doorknob.

U.S. Pat. No. 5,309,145, issued on May 3, 1994 to Branch et al., describes a travel convenience and security device. In the security device, a clock, a lamp, an alarm, a motion detector, as well as a smoke alarm are combined in a single device. If motion occurs under circumstances suggesting that an intruder is present or smoke is detected, then an alarm signal and the degree of illumination alert the user to a potential security concern.

Various other patents issued in the past relating to door security and alarms, including U.S. Pat. Nos. 5,392,026, 4,483,558, 4,563,027, and 4,607,253. These patents generally fall into the door brace category.

Various apparatuses have been developed in the past related to enhancing the strength, and thus the security, of a conventional door. For example, various arrangements utilizing bars, chains, and the like have been utilized in the past to enhance security and the strength of a door. These solutions can sometimes be effective, however are often bulky and cumbersome to use. Further, some of the door security enhancements, such as a simple chain door fastener provide a false sense of security.

Referring to FIGS. 1 and 1A, there is shown a door securement device in the prior art. The device shown in FIGS. 1 and 1A is considered by the applicant to strongly enhance the strength of a door, preventing it from being kicked in and coming off its hinges.

FIGS. 1 and 1A show the prior art door securement apparatus 10. The apparatus 10 includes a plate member 12 (shown more clearly in FIG. 1A) and a bracket member 14. The plate member 12 is mounted in the door jamb 16. The plate member 12 has a protrusion 26 extending outwardly therefrom. The plate member 12 also contains a plurality of screw holes 24 formed therethrough. Screws are utilized to secure the plate member 12 in the door jamb of a door adjacent the door hinges. When the door is closed, the protrusion 26 extends outwardly from the door jamb to the interior of the room.

The bracket member 14 has a slot 18 formed therein. The slot 18 is suitable for positioning over and receiving the protrusion 26 of the plate member 12. FIG. 1 shows how the protrusion 26 is adjacent the door jamb 16. The slot 18 of the bracket member 14 is shown as being moved downwardly towards the protrusion 26. When the protrusion 26 is received in a slot 16 of the bracket member 14, the bracket member 14 is secured against the door 28 on one end thereof and the doorframe or wall 30 on an opposite end.

The bracket member 14 has a first wing 20 and second wing 22 extending outwardly therefrom. The first wing 20 is shown as bearing against the door 28, while the second wing 22 is shown as bearing against the doorframe or wall 30 on the other side of the door jamb 16.

FIG. 1A shows how the protrusion 26 of the plate member 12 is formed such that a groove of the protrusion is received within the slot 18, while the end of the protrusion 26 holds the bracket member 14 in place.

This apparatus proves successful in preventing intrusions, and was believed to have been sold under the trademark "Cops Lock" or "Eagle Lock". It is the applicant's belief that the product is no longer available on the market. Additionally, it is believed that there was a patent or patent application related to this apparatus or a similar apparatus. However, Applicant has been unable to identify or find such a patent or patent application after a diligent search.

The device shown in FIGS. 1 and 1A, while very effective in enhancing the strength of the door, does not provide an alarm function. Further, the wings of the bracket member 14 of the prior art door securement apparatus 10 can damage the door or wall surface.

It is an object of the present invention to provide a door security system which enhances the physical strength of the door and doorframe.

It is another object of the present invention to provide a door security system which both enhances the physical strength of the door and provides for an alarm function.

It is yet another object of the present invention to provide a door security system which does not damage the door or wall surface adjacent thereof in the event that a break-in is attempted.

It is another object of the present invention to provide a door security system which provides for increased strength over the apparatuses of the prior art.

It is another object of the present invention to provide a door security system which has a removable alarm for use during travel.

It is another object of the present invention to provide a door security system which is easy to use.

These and other objects and advantages of the present invention will become apparent from a reading of the attached specification and appended claims.

BRIEF SUMMARY OF THE INVENTION

In one embodiment, the present invention is a security system for use with a door with a door jamb. The security system includes a plate member mountable in the door jamb adjacent the hinges of the door. The plate member has a protrusion extending outwardly therefrom. A bracket member has a slot for receipt of the protrusion of the plate member. The bracket member has first and second wings extending outwardly therefrom. The bracket member has an alarm receiver on a front side thereof. A vibration-activated alarm is removably received by the alarm receiver.

In an embodiment, the surface of the plate member has a plurality of screw holes formed therethrough, which preferably are extruded so as to extend outwardly from the surface of the plate member.

In an embodiment of the present invention, the first wing of the bracket member bears against the door when the door is closed, and the second wing of the bracket member bears against the surface adjacent the door when the door is closed.

In an embodiment, each of the first wing and the second wing have a non-metallic material on ends thereof for bearing against the door or area adjacent the door.

In an embodiment of the present invention, the alarm receiver includes a pair of opposing slots. Preferably, the plate member and the bracket member are constructed of aluminum.

In an embodiment of the present invention, the vibration alarm includes a body suitable for receipt by the alarm receiver, a speaker on the body, and a control panel that is suitable for arming the vibration alarm. Preferably, the vibration alarm has an adhesive surface on the back side thereof wherein the adhesive surface is suitable for securing the vibration alarm directly to a door. Other attachment means can be provided within the concept of the present invention.

The system of the present invention may also include a holder with a protrusion suitable for receiving the slot of the bracket member when the bracket member is not being used. The holder is mountable to the wall adjacent the door.

In one embodiment of the present invention, the alarm receiver is formed integrally with the bracket member on the front side thereof. In this embodiment, the vibration-activated alarm is removably received by the alarm receiver.

In one embodiment of the present invention, the first and second wings of the bracket member extend angularly outwardly from the middle portion of the bracket member. In this embodiment, the wings of the bracket member may have ends which are coplanar with the middle portion of the bracket member.

In an embodiment, the present invention is an apparatus including a plate member with a protrusion extending outwardly therefrom. The plate member has a plurality of screw holes formed therethrough. The plurality of screw holes are extruded so as to extend outwardly of the surface of the plate member. A bracket member has a slot for receipt of the protrusion of the plate member. The bracket member has first and second wings extending outwardly therefrom. A vibration activated alarm is affixed to the bracket member. In one embodiment, the vibration-activated alarm is removably affixed to the bracket member.

This foregoing Section is intended to describe, in generality, the preferred embodiment of the present invention. It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1A:
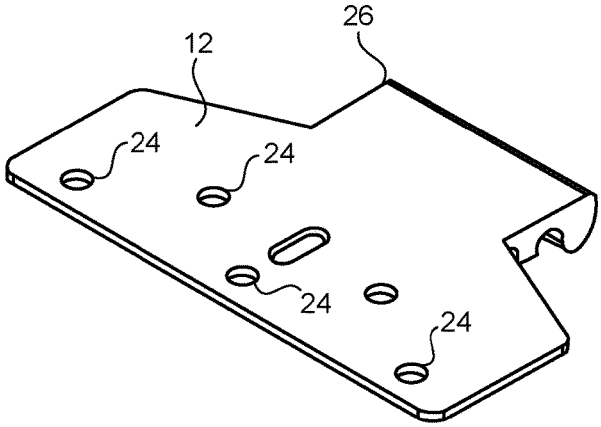
FIG. 1A PRIOR ART
FIGS. 1 and 1A show views of a door securement apparatus of the prior art.
Figure 1:
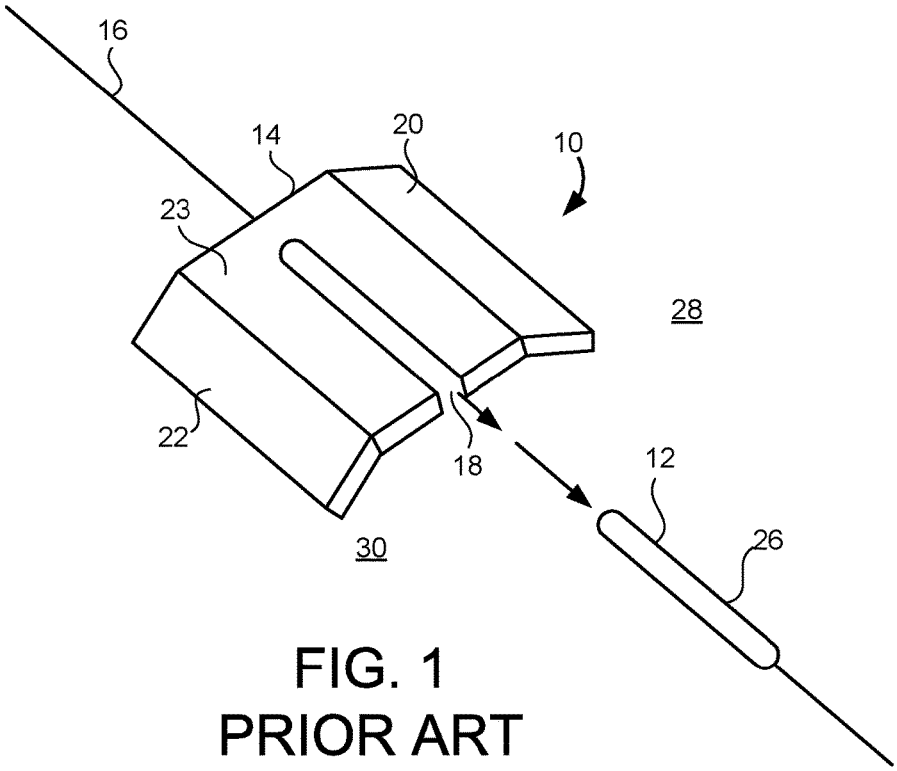
FIG. 1 PRIOR ART
Figure 2:
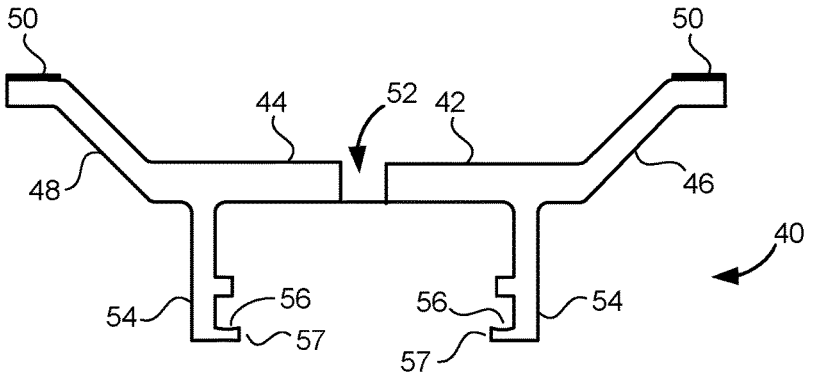
FIG. 2 shows a top view of the bracket member of the door security system of the preferred embodiment of the present invention.

Referring to FIG. 2, there is shown a top view of the bracket member 42 of the door security system 40 of the preferred embodiment of the present invention. The bracket member 42 includes a middle portion, or planar surface, 44. A first wing 46 extends angularly outwardly from the middle portion 44, while a second wing 48 extends angularly outwardly from the middle portion 44 at an end opposite thereof. The first wing 46 and second wing 48 preferably have ends 50. The ends 50 of the first and second wings 46 and 48 are preferably coplanar with the middle portion 44 of the bracket member 42.

Preferably, the bracket member 42 is constructed of aircraft aluminum. In a preferred embodiment of the present invention, the ends 50 of the wings 46 and 48 are either constructed of a non-metallic material or have a non-metallic coating thereon. The coating is preferably a soft material such that when the ends 50 of the wings 46 and 48 are bearing against the door surface or wall surface adjacent the door, damage does not occur to the door or wall surface.

Figure 3:
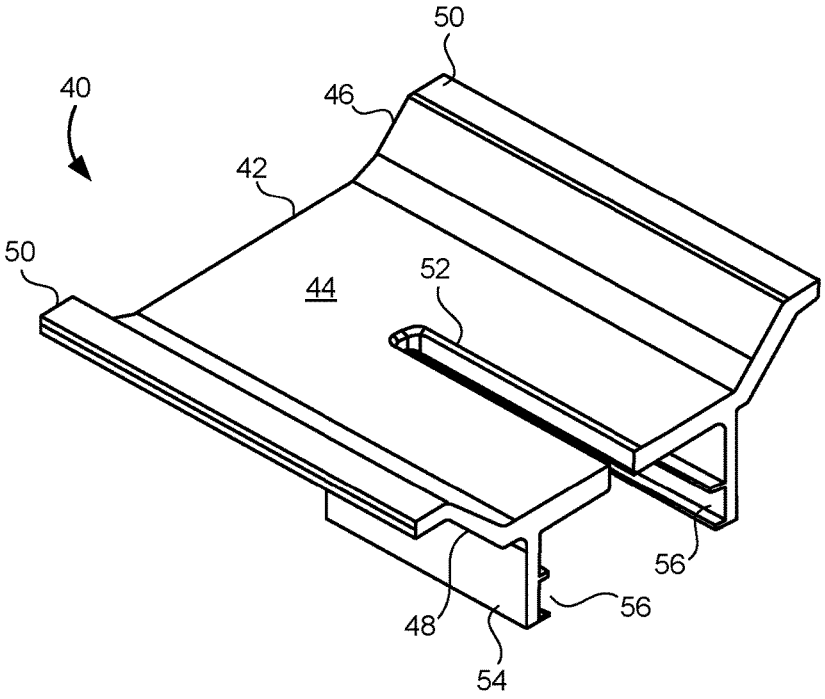
FIG. 3 shows a rear perspective view of the bracket member of the door security system of the present invention.

FIGS. 2 and 3 also show how the bracket member 42 of the door security system 40 has a plate member receiving slot 52. As shown in FIG. 3, the plate member receiving slot 52 extends approximately halfway through the middle portion 44 of the bracket member 42.

FIGS. 2 and 3 also show the alarm receiver 56. In a preferred embodiment of the present invention, the alarm receiver 56 comprises a pair of arms 54 which extend outwardly from the middle portion 44 of the bracket member 42. Preferably, the alarm receiver 56 includes a pair of opposing slots 57. The pair of opposing slots 57 are suitable for receiving a portable alarm, which is described hereinbelow. Preferably, the slots 57 are integrally formed with the arms 54 and with the remainder of the bracket member 42 so as to efficiently transfer vibration forces from the door through the bracket member and to the vibration alarm so as to the trigger the vibration alarm in the event of an attempted break-in.

Figure 4:
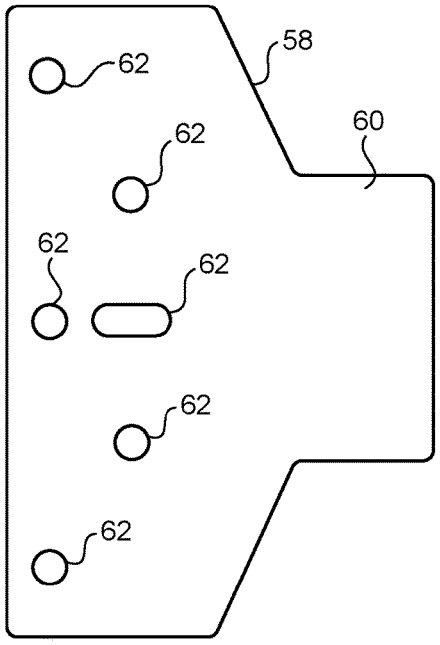
FIG. 4 shows a side view of the plate member of the door security system of the present invention.
Figure 5:
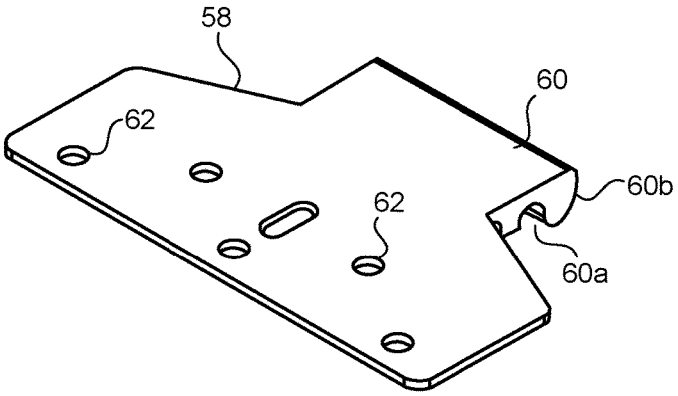
FIG. 5 shows a perspective view of the plate member of the door security system of the present invention.

Referring to FIGS. 4 and 5, there is shown the plate member 58 of the door security system 40 of the present invention. The plate member 58 includes a protrusion 60. A plurality of screw holes 62 are formed through the plate member 58. Referring to FIG. 5, it can be seen how the protrusion 60 includes a groove 60*a* and a lobe 60*b*. The groove 60*a* traverses the slot 52 of the bracket member 42, while the lobe 60*b* is sized so as to prevent the bracket member 42 from coming off the plate member 58 when the protrusion 60 is received in the slot 52 of the bracket member 42.

FIG. 5 illustrates how the plurality of screw holes 62 of the plate member 58 are extruded so as to extend outwardly from the surface of the plate member 58. When secured in the door jamb with screws, the extruded screw holes 62 cut into the surface of the doorjamb, thus enhancing the effectiveness of the door security system 40, and thus the strength of the door. The bracket member and the plate member of the door security system 40 are intended to be used in a permanent manner, and probably would not be suitable for use during travel, given the need to secure the plate member with a plurality screws.

Figure 6:
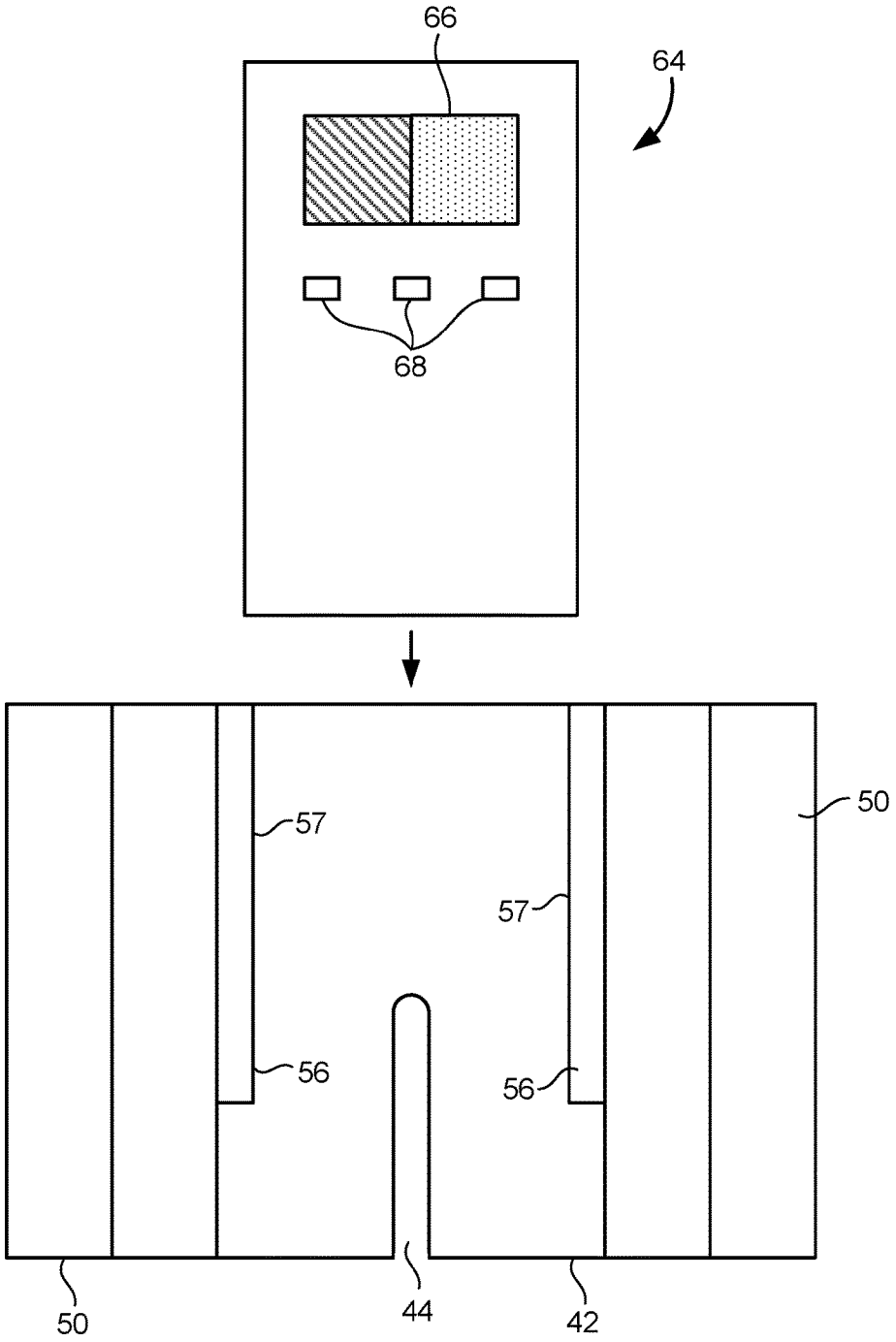
FIG. 6 shows receipt of the vibration alarm of the door security system of the present invention by the bracket member.

Referring to FIG. 6, there is shown the vibration alarm 64 of the door security system 40 of the present invention. The vibration alarm 64 is a vibration-activated alarm, is preferably sized similar to a small cellular telephone. The vibration alarm 64 includes a screen and speaker area 66, with a control panel 68. As shown in FIG. 6, the vibration alarm 64 is received by the alarm receiver 56 of the bracket member 42. FIG. 6 shows the alarm receiver 56 in the form of a pair of opposing slots 57. The vibration alarm 64 can optionally be attached or mounted to the bracket member 42 in a number of ways. Preferably however, the vibration alarm 64 is attached in such a manner that the vibration from an attempted break-in is transferred from the bracket member 42 to the vibration alarm 64. Alternately, the vibration alarm 64 can be permanently attached to the bracket member 42.

Figure 7:
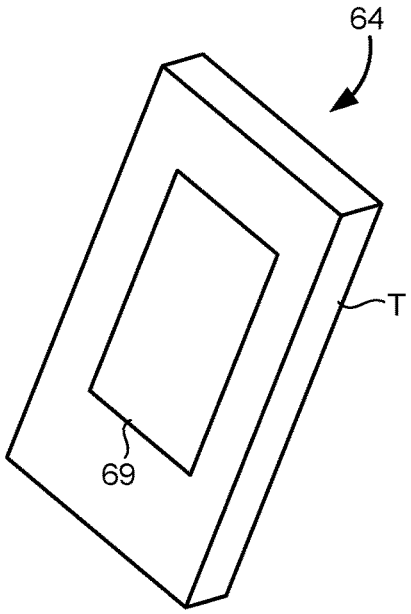
FIG. 7 shows a rear perspective view of the door vibration-activated alarm of the door security system of the present invention.

Preferably, the vibration alarm 64 is removable so as to be used during travel. Referring to FIG. 7, there is shown a rear perspective view of the vibration alarm 64 of the preferred embodiment of the present invention. In FIG. 7, it can be seen how an adhesive 69 is positioned on the back side of the vibration alarm 64. The adhesive 69 is positioned centrally on the back of the vibration alarm 64 so as to not interfere with the alarm receiver 56 of the bracket member 42. The adhesive 69 is utilized to attach the vibration alarm 64 to a door or other surface remote from the plate member 58. For example, the vibration alarm 64 can be utilized in a hotel. If the door is contacted, then the vibration alarm 64 emits an audible sound so as to deter a possible thief or assailant. The adhesive 69 can also be any number of attachment means, including magnets and the like.

FIG. 7 also shows how the vibration alarm 64 has a thickness T. The thickness T is suitable for receipt within the pair of opposing slots 57 of the alarm receiver 56. Preferably, the thicknesses are such that the vibration alarm 64 us secured by interference fit. However, horizontal bottom portions could be provided in the pair of opposing slots 57 such that the vibration alarm 64 sits thereon. The interference fit is preferred in that it provides for better transfer of vibration during an attempted break-in.

The vibration alarm 64 preferably uses a cellular or wireless service that may not need to be monitored on a constant basis. As such, users of the door security system of the present invention can avoid paying monthly fees to security companies.

Figure 8:
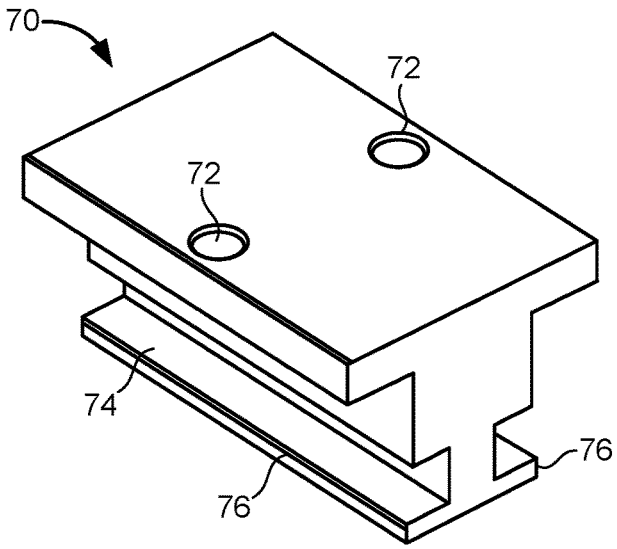
FIG. 8 shows a rear perspective view of the bracket holder of the door security system of the present invention.

Referring to FIG. 8, there is shown a holder 70 for the bracket member 42. The holder 70 can be secured to an area adjacent the door upon which the security system 40 is being used. Preferably, the holder 70 includes a pair of screw holes 72 such that the holder 70 can be securely mounted to the wall. Similar to the plate member, the holder 70 has a protrusion 74 extending outwardly therefrom. The protrusion 74 is suitable for receiving the slot 52 of the bracket member 42. A lip 76 is provided on the protrusion 74 so as to prevent the bracket member 42 from coming off of the holder 70. The holder 70 enhances the ease and convenience of use of the door security system 40 of the present invention. The protrusion 74 of the holder 70 is sized such that it prevents the wings of the bracket member from contacting the wall surface when the bracket member 42 is being stored on the holder 70.

The door security system of the present invention is very versatile in that it allows for a very secure entry at one's home or place of business, and also allows for a simple, portable alarm system. Further, the door security system of the present invention allows for easy removal of the vibration alarm such that the vibration alarm can be used during travel or when outside of the home for other reasons.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A security system for use with a door having a doorjamb, the security system comprising:

a plate member mountable in the door jamb adjacent the hinges of the door, said plate member having a protrusion extending outwardly therefrom;

a bracket member having a slot for receipt of said protrusion of said plate member, said bracket member having first and second wings extending outwardly therefrom, said bracket member having an alarm receiver on a front side thereof; and a vibration-activated alarm removably received by said alarm receiver.

2. The security system of claim 1, said plate member having a plurality of screw holes formed therethrough.

3. The security system of claim 2, said plurality of screw holes being extruded so as to extend outwardly from a surface of said plate member.

4. The security system of claim 1, said first wing of said bracket member bearing against the door when the door is closed, said second wing of said bracket member bearing against a surface adjacent the door when the door is closed.

5. The door security system of claim 1, each of said first wing and said second wing having non-metallic material on ends thereof for bearing against the door or area adjacent the door.

6. The security system of claim 1, said alarm receiver comprising a pair of opposing slots.

7. The security system of claim 1, said plate member and said bracket member each being constructed of aluminum.

8. The security system of claim 1, said vibration alarm comprising:

a body suitable for receipt by said alarm receiver;

a speaker on said body; and a control panel suitable for arming said vibration alarm.

9. The security system of claim 8, said vibration alarm having an adhesive surface on a back side thereof, said adhesive surface suitable for securing said vibration alarm directly to a door.

10. The security system of claim 1, further comprising:

a holder having a protrusion suitable for receipt of said slot of said bracket member, said holder being mountable to the wall adjacent the door.

11. A security system for use with a door with a doorjamb, the security system comprising:

a plate member mountable in the door jamb adjacent the hinges of the door, said plate member having a protrusion extending outwardly therefrom;

a bracket member having a slot for receipt of said protrusion of said plate member, said bracket member having first and second wings extending outwardly therefrom;

an alarm receiver formed integrally with said bracket member on a front side thereof; and a vibration-activated alarm removably received by said alarm receiver.

12. The security system of claim 11, said alarm receiver having a pair of opposing slots, said vibration-activated alarm being removably received by said pair of opposing slots of said alarm receiver.

13. The security system of claim 11, said plate member having a plurality of screw holes formed therethrough.

14. The security system of claim 13, said plurality of screw holes being extruded so as to extend outwardly from said plate member.

15. The security system of claim 11, said vibration-activated alarm having an adhesive surface on a back side thereof, said adhesive surface suitable for securing said vibration-activated alarm directly to a door.

16. The security system of claim 11, said first and second wings of said bracket member extending angularly outwardly from a middle portion of said bracket member.

17. The security system of claim 16, said first and second wings of said bracket member having ends which are coplanar with said middle portion of said bracket member.

18. The security system of claim 17, said ends of said first and second wings of said bracket member having a non-metallic material thereon for bearing against a door or other surface.

19. An apparatus comprising:

a plate member having a protrusion extending outwardly therefrom, said plate member having a plurality of screw holes formed therethrough, said plurality of screw holes being extruded so as to extend outwardly of a surface of said plate member;

a bracket member having a slot for receipt of said protrusion of said plate member, said bracket member having first and second wings extending outwardly therefrom; and a vibration-activated alarm affixed to said bracket member.

20. The apparatus of claim 19, said vibration-activated alarm being removably affixed to said bracket member.

* * * * *